US006656295B2

(12) United States Patent
Sircar

(10) Patent No.: US 6,656,295 B2
(45) Date of Patent: Dec. 2, 2003

(54) FREE MACHINING ALUMINUM ALLOY WITH HIGH MELTING POINT MACHINING CONSTITUENT

(75) Inventor: Subhasish Sircar, Richmond, VA (US)

(73) Assignee: Reynolds Metals Company, Richmond, VA (US)

( * ) Notice: Subject to any disclaimer, the term of this patent is extended or adjusted under 35 U.S.C. 154(b) by 0 days.

(21) Appl. No.: 10/106,247

(22) Filed: Mar. 27, 2002

(65) Prior Publication Data

US 2002/0100523 A1 Aug. 1, 2002

Related U.S. Application Data

(63) Continuation of application No. 09/295,160, filed on Apr. 20, 1999, now Pat. No. 6,416,598.

(51) Int. Cl.[7] ..... C22C 21/00
(52) U.S. Cl. ..... 148/437
(58) Field of Search ..... 148/437

(56) References Cited

U.S. PATENT DOCUMENTS

| | | | | |
|---|---|---|---|---|
| 3,885,959 A | | 5/1975 | Badia et al. | |
| 4,836,982 A | | 6/1989 | Brupbacher et al. | |
| 4,888,054 A | | 12/1989 | Pond | |
| 5,015,534 A | * | 5/1991 | Kampe et al. | 428/570 |
| 5,217,816 A | | 6/1993 | Burpbacher et al. | |
| 5,228,494 A | | 7/1993 | Rohatgi | |
| 5,259,435 A | | 11/1993 | Miura et al. | |
| 5,498,269 A | | 3/1996 | Larmie | |
| 5,624,632 A | | 4/1997 | Baumann et al. | |
| 5,626,692 A | | 5/1997 | Rohatgi et al. | |
| 5,711,362 A | | 1/1998 | Rohatgi | |

OTHER PUBLICATIONS

ASM Handbook vol. 2, "Properties and Selection: Nonferrous Alloys and Special–Purpose Materials", pub. by ASM International, 1992, pp. 7–8, 17–21, 46–47.*

* cited by examiner

*Primary Examiner*—Roy King
*Assistant Examiner*—Harry D. Wilkins, III
(74) *Attorney, Agent, or Firm*—Christopher W. Brody; David Pearce-Smith

(57) ABSTRACT

A free machining aluminum alloy contains an effective amount of one or more high melting point constituents that provide enhanced machining capability. The high melting point constituents occupy from about 0.1 to about 3.0 volume percent of the aluminum alloy. The constituents can be any material that is essentially insoluble in the aluminum alloy matrix so as to form a discontinuity and one that will resist deformation during machining to enhance the formation of voids between the matrix and the free machining constituents. The constituents include elements, nitrides, oxides, borides, carbides, silicides, aluminides and combinations thereof that have a high melting point and high strength and low solubility in aluminum at the elevated temperature so that the constituents resist deformation during the machining operation. The free machining aluminum alloy can be formed as a workpiece and subjected to any machining operation.

10 Claims, No Drawings

FREE MACHINING ALUMINUM ALLOY WITH HIGH MELTING POINT MACHINING CONSTITUENT

CROSS REFERENCE TO RELATED APPLICATION

This application is a continuation of U.S. patent application Ser. No. 09/295,160, filed Apr. 20, 1999 now U.S. Pat. No. 6,416,598.

FIELD OF THE INVENTION

The present invention is directed to a free machining aluminum alloy and, in particular, to an aluminum alloy utilizing a high melting point material as a free machining constituent thereof.

BACKGROUND ART

Free machining aluminum alloys are well-known in the art. These alloys typically include free machining constituents such as lead, tin, indium and bismuth for improved machinability. In many of these alloys, these constituents form low melting point compounds which readily melt or soften due to the friction heat created during machining. With the melting or softening of the low melting point compounds, material removal as part of the machining process is easily facilitated.

One of the drawbacks with these types of free machining alloys is the tendency for the free machining constituents to deform or flow with the matrix material being worked by the machining tool. Since these free machining constituents, either in elemental or compound form, have a relatively low melting point, their flow properties tend to match those of the aluminum matrix. Consequently, when the aluminum matrix deforms due to machining, the low melting point elements or compounds tend to deform in a similar fashion. The tendency for the free machining constituent to deform with the metal matrix retards formation of voids in the alloy. Void formation as a result of machining is a preferred mode for metal removal since it enhances generation of finely sized machining debris. By delaying the void formation and subsequent material removal through the generation of machining chips, the machining tool does more work and tool life is reduced.

In light of the drawbacks noted above with respect to prior art free machining aluminum alloys, a need has developed to provide an improved free machining alloy which enhances the machining process.

In response to this need, the present invention provides a free machining alloy containing a volume fraction of a high melting point free machining constituent that enhances void formation during machining.

SUMMARY OF THE INVENTION

Accordingly, it is a first object of the present invention to provide an improved free machining aluminum alloy.

Another object of the invention is to provide a free machining aluminum alloy utilizing one or more high melting point machining constituents for increased machine tool life.

A still further object of the invention is to provide a method of machining an aluminum alloy material by utilizing a free machining aluminum alloy containing an effective amount of a high melting point free machining constituent.

Other objects and advantages of the present invention will become apparent as a description thereof proceeds.

In satisfaction of the foregoing objects and advantages, the present invention is an improvement over prior art aluminum alloys containing one or more free machining constituents. According to the invention, an aluminum alloy is modified with a free machining constituent. The free machining constituent comprises at least one or more high melting point materials. The high melting point materials comprise between about 0.1% and about 3.0% by volume of the free machining aluminum alloy.

A more preferred volume percent ranges between about 0.2% and 2.0% with an even more preferred range being between about 0.3% and 1.5%. Another preferred range is between about 0.4% and 1.0%.

The high melting point material can be any material which is essentially insoluble in the aluminum alloy matrix and is one that remains stable or does not soften or melt during the machining operation. The melting point of the material should be greater than the melting point of the aluminum alloy matrix. The melting point of the aluminum is about 1220° F. (660° C.). Thus, materials meeting the requirements above that remain solid in spite of the matrix material melting or softening are candidates as the free machining constituent of the invention.

The high melting point material can be one material or a combination of different materials providing that the mixture remains within the volume percents recited above.

The high melting point material can be either in elemental form or in the form of a compound. Examples of high melting point compounds include carbides, nitrides, borides, silicides, oxides, aluminides or combinations thereof. Elements include boron, carbon or graphite, various refractory elements and the like.

The invention also includes providing a workpiece made from the inventive aluminum alloy composition and subjecting it to a machining operation to form a desired shape. The machined product containing the inventive aluminum alloy composition is also within the purview of the invention.

DESCRIPTION OF THE PREFERRED EMBODIMENTS

The present invention offers significant improvements in the machining of aluminum alloys. That is, by modifying known aluminum alloys to include a free machining constituent that is insoluble in the aluminum alloy matrix and has a high melting point, a discontinuity as the constituent is dispersed throughout the matrix. Improved machining occurs as a result of enhancing material removal during machining and lengthening the machining tool life.

In its broadest embodiment, the invention is an improvement over known aluminum alloys containing free machining compounds or elements such as lead-bismuth, tin, tin-bismuth and the like. According to the invention, a volume percent ranging from about 0.1% to about 3.0% of one or more high melting point free machining constituents is included as part of the aluminum alloy.

The composition of the aluminum alloy can vary depending on the desired application of the material being machined. It is believed that the free machining constituent described above can be used in aluminum alloys of the series AA1000, AA2000, AA3000, AA5000, AA6000 and AA7000. More preferably, the invention has applicability for AA2000 and AA6000 series alloys. A preferred alloy composition includes AA6061 which has a registered composition, in weight percent as follows: 0.40%–0.80% silicon; a maximum of 0.7% iron; 0.15%–0.40% copper; a maximum of 0.15% manganese; 0.8%–1.2% magnesium; 0.04%–0.35% chromium; a maximum of 0.25% zinc; a maximum of 0.15% titanium; other elements individually being at a maximum of 0.05% and further being at a collective maximum of 0.15%; with the balance aluminum and incidental impurities.

The volume fraction range of the high melting constituent of about 0.1% to about 3.0% by volume includes preferred ranges of about 0.2% to 2.0%, even more preferred ranges of 0.3% to 1.5% and 0.4% to 1.0%, and even a target of 0.5%.

If so desired, the volume percentages defined above can be converted to weight percentages based on the material being used as the free machining constituent and the aluminum alloy matrix material. Although this conversion is well within the skill of the art, an exemplary conversion is detailed below for better understanding of the invention.

Assuming that the inventive free machining alloy composition utilizes an AA6061 alloy containing 2% by volume of silicon carbide, the weight percent of silicon carbide is calculated as follows. Using the equality that mass equals density times volume, a density of 3.217 for silicon carbide for two parts by volume of silicon carbide equals 6.434 parts by weight. Similarly, 98 parts by volume of aluminum, using a density of 2.7 for aluminum, translates to 264.6 parts by weight. Thus, to obtain two volume percent of silicon carbide in aluminum, 2.37 weight percent [6.434×100/(264.6+6.434)] of silicon carbide is needed. Generally, the free machining constituent will be heavier than the aluminum alloy matrix so that the corresponding weight percentage is generally higher than the volume percent.

In a preferred mode, the free machining constituent can have a density which is similar to the density of aluminum. Although similarity in density is not a prerequisite of the invention, matching the density of the free machining constituent to the aluminum alloy can facilitate uniform dispersing the constituent when it is added to a molten aluminum alloy.

The free machining constituent should be uniformly dispersed in the aluminum alloy matrix so that generation of machining debris occurs uniformly throughout the part, regardless of the location of the machining site.

A preferred size distribution for the free machining constituent ranges between about 0.1 and 10 microns, more preferably between about 0.5 and 5 microns. This size distribution is generally measured transverse to the direction of working that the workpiece was subjected to prior to machining.

The free machining constituent of the inventive alloy is defined as a high melting point material that forms a discontinuity when dispersed in the matrix of the aluminum alloy. The material is essentially insoluble in the aluminum alloy matrix and exhibits flow properties that enhance void formation between the constituent and the matrix during machining. More particularly, the high melting point material does not substantially deform, soften or smear when the aluminum alloy is being machined. Consequently, when the aluminum alloy matrix material is being deformed as a result of the machining operation, the high melting point free machining constituents remain relatively stable with respect to the matrix. Thus, the matrix material tends to separate from the free machining constituents to generate voids in the matrix. Void generation continues and the voids propagate, ultimately resulting in material separation and the generation of finely sized machining debris and metal removal from the workpiece being machined.

The enhanced metal removal results in several improvements in the overall machining process. Since generation of machining debris is enhanced, less work is required for metal removal. This results in extended tool life. Further, less heat is generated in the workpiece during machining, thereby reducing any adverse effect on the properties of the workpiece due to the generation of excessive heat. The void formation also contributes to formation of finely sized machining debris, thereby facilitating debris removal from the machining tool and reducing the potential for machining operation interruption by the debris interfering with the operation. Also, dimensional tolerances in the finished part are easily maintained.

The melting point of the constituent is such that melting of the matrix occurs prior to melting of the constituent. Pure aluminum melts around 1220° F. (660° C.). An exemplary free machining constituent such as tungsten carbide melts at 5198° F. (2870° C.). Thus, the tungsten carbide as a dispersion in an aluminum alloy such as AA6061 will function as a discontinuity in the matrix, facilitating void formation and propagation during the deformation of the aluminum alloy matrix that occurs during a machining operation.

The constituent can be an element such as carbon (graphite) or boron or a compound such as a ceramic, e.g., a carbide, oxide, nitride, boride, silicide, or an intermetallic, e.g., a nickel aluminide. It could also be a high melting refractory metal. More than one type of a constituent can be employed providing the desired volume fraction is maintained.

If selecting an oxide, the oxide can be aluminum oxide, silicon oxide, titanium oxide, cerium oxide, beryllium oxide, chromium oxide, other rare earth oxides, thallium oxide, iron oxide, nickel oxide, tantalum oxide, tungsten oxide, zirconium oxide, magnesium oxide, and combinations thereof. More complex oxides containing one or more of the elements recited above when combined with oxygen are also within the scope of the invention. Rare earth oxides such as scandium oxide, yttrium oxide, lanthanum oxide, cerium oxide are just examples of oxides based on rare earth elements that can be selected from Group IIIB of the Periodic Table.

Examples of carbides include titanium carbide, zirconium carbide, hafnium carbide, vanadium carbide, niobium carbide, tantalum carbide, chromium carbide, molybdenum carbide, tungsten carbide, iron carbide, silicon carbide, boron carbide and combinations thereof.

When using a nitride, the nitride can include titanium nitride, zirconium nitride, hafnium nitride, vanadium nitride, tantalum nitride, niobium nitride, chromium nitride, iron nitride, silicon nitride, boron nitride, and combinations thereof.

Borides are also within the scope of the invention, including titanium boride, zirconium boride, hafnium boride, vanadium, boride, niobium boride, tantalum boride, chromium boride, molybdenum boride, tungsten boride, and combinations thereof.

Silicides can also be used wherein one or more of the silicides could include titanium silicide, vanadium silicide, niobium silicide, tantalum silicide, chromium silicide, molybdenum silicide, and combinations thereof.

Aluminides, such as nickel aluminide, and titanium aluminide, could also be used as one of the free machining constituents applicable for the invention.

The free machining constituent can also include more complex compounds where two or more oxides, carbides, etc. or mixtures thereof may form the compound. Other materials such as slags, fly ashes or the like could also be employed as the free machining constituent.

Examples of high melting, refractory elements include tungsten, molybdenum, niobium, tantalum and similar.

Specific examples of the invention include an AA6061 aluminum alloy with a volume percent within the ranges specified above of one of aluminum oxide, silicon nitride, boron carbide, boron, boron nitride, a rare earth oxide such as cerium oxide, and titanium oxide. Another example includes AA2000 series alloys such as AA2011, 2111, 2012 wherein the free machining elements of these alloys, i.e, lead-bismuth or tin-bismuth, are replaced with a volume percent of the high melting point constituents of the invention as specified above.

The inventive free machining aluminum alloy composition can be formed into any shape suitable for machining. Processes to form the shapes include casting, cold and hot deformation processes such as extruding, forging, rolling, as well as cold deformation processes. Once the workpiece to be machined is made, it can be subjected to conventional machining and any post machining operations necessary prior to machined product use.

The high melting point material could be any element or compound or a mixture of elements and compounds which would essentially form a void in the aluminum article during the machining operation and thus enable chip formation and improved machinability.

This method as one skilled in the art would immediately ascertain, can easily be extended to various materials and matrices, included but not limited to nonferrous metals and alloys.

As such, an invention has been disclosed in terms of preferred embodiments thereof which fulfill each and every one of the objects of the present invention as set forth above and provides a new and improved free machining aluminum alloy and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a free machining aluminum alloy article having at least one free machining constituent, the free machining constituent being present in the free machining aluminum alloy article in an amount to improve metal removal from the article during machining, the improvement comprising the free machining constituent being at least one high melting point material and the amount being between about 0.1 and 0.5% by volume of the free machining aluminum alloy.

2. The improvement of claim 1, wherein the high melting point material is one of an element and a compound.

3. The improvement of claim 1, wherein the high melting point material is a compound selected from the group consisting of a carbide, a nitride, a boride, a suicide, an oxide, and aluminide or a combination thereof.

4. The improvement of claim 1, wherein the high melting point material is one of: a) an oxide selected from the group consisting of aluminum, silicon oxide, titanium oxide, beryllium oxide, chromium oxide, thallium oxide, zirconium oxide, a rare earth oxide, magnesium oxide, iron oxide, nickel oxide, tantalum oxide, tungsten oxide, vanadium oxide, and combinations thereof; b) a carbide selected from the group consisting of titanium carbide, zirconium carbide, hafnium carbide, vanadium carbide, niobium carbide, tantalum carbide, chromium carbide, molybdenum carbide, tungsten carbide, iron carbide, silicon carbide, boron carbide and combinations thereof; c) a nitride selected from the group consisting of titanium nitride, zirconium nitride, hafnium nitride, vanadium nitride, tantalum nitride, niobium nitride, chromium nitride, iron nitride, silicon nitride, boron nitride, and combinations thereof; d) a boride selected from the group consisting of titanium boride, zirconium boride, hafnium boride, vanadium boride, niobium boride, tantalum boride, chromium boride, molybdenum boride, tungsten boride, and combinations thereof; and e) a silicide selected from the group consisting of titanium silicide, vanadium silicide, niobium silicide, tantalum silicide, chromium silicide, molybdenum silicide, tungsten boride, and combinations thereof.

5. The improvement of claim 3, wherein the compound is an aluminide.

6. The improvement of claim 2, wherein the material is an element selected from the group consisting of carbon, boron, tungsten, cobalt, tantalum, molybdenum, and the combination thereof.

7. The improvement of claim 1, wherein the aluminum alloy is selected from the group consisting of AA1000, AA2000, AA3000, AA5000, AA6000, and AA7000 series alloys.

8. The improvement of claim 3, wherein the aluminum alloy is one of an AA2000 and AA6000 series alloy.

9. The improvement of claim 2, wherein the material is an element selected from the group consisting of tungsten, cobalt, tantalum, molybdenum, and the combination thereof.

10. The improvement of claim 1, wherein the article is one of a forging, a rolling, and an extrusion.

* * * * *

UNITED STATES PATENT AND TRADEMARK OFFICE

CERTIFICATE OF CORRECTION

PATENT NO. : 6,656,295 B2
DATED : December 2, 2003
INVENTOR(S) : Subhasish Sircar It is certified that error appears in the above-identified patent and that said Letters Patent is hereby corrected as shown below:

Column 6,
Line 7, insert -- silicide -- delete "suicide".

Signed and Sealed this

First Day of November, 2005

JON W. DUDAS
*Director of the United States Patent and Trademark Office*